US008893357B1

(12) United States Patent
Deiters

(10) Patent No.: US 8,893,357 B1
(45) Date of Patent: Nov. 25, 2014

(54) CREMATION BOX AND ROLLER SYSTEM

(71) Applicant: Gary W Deiters, Washington, IL (US)

(72) Inventor: Gary W Deiters, Washington, IL (US)

( * ) Notice: Subject to any disclaimer, the term of this patent is extended or adjusted under 35 U.S.C. 154(b) by 0 days.

(21) Appl. No.: 14/053,146

(22) Filed: Oct. 14, 2013

(51) Int. Cl.
*A61G 17/00* (2006.01)
*A61G 17/04* (2006.01)
*A61G 19/00* (2006.01)

(52) U.S. Cl.
CPC ..... *A61G 17/04* (2013.01); *A61G 19/00* (2013.01)
USPC ..... 27/2; 27/27; 110/194

(58) Field of Classification Search
USPC ..... 27/1, 2, 4, 27, 35, 32; 110/194; 16/18 R, 16/30; 312/249.1, 249.8
See application file for complete search history.

(56) References Cited

U.S. PATENT DOCUMENTS

| | | | | |
|---|---|---|---|---|
| 3,133,334 | A * | 5/1964 | Johnsen | 27/27 |
| 3,559,802 | A * | 2/1971 | Eidus | 206/318 |
| 3,613,189 | A * | 10/1971 | Kirby | 27/35 |
| 4,156,956 | A | 6/1979 | Partridge | |
| 4,890,367 | A | 1/1990 | Crawford | |
| 5,136,751 | A * | 8/1992 | Coyne et al. | 16/29 |
| 5,307,545 | A * | 5/1994 | Stoltz | 27/4 |
| 5,379,485 | A * | 1/1995 | Oshins et al. | 16/24 |
| 5,586,679 | A | 12/1996 | Thomas | |
| 5,661,879 | A * | 9/1997 | Kelly | 27/2 |
| 6,038,734 | A * | 3/2000 | Facchin | 16/24 |
| 6,202,270 | B1 * | 3/2001 | Bowman et al. | 27/4 |
| 6,557,221 | B2 * | 5/2003 | Cox et al. | 27/4 |
| 6,571,440 | B1 * | 6/2003 | Faulkner et al. | 27/4 |
| 6,772,478 | B2 * | 8/2004 | Herder et al. | 16/42 R |
| 7,003,855 | B2 | 2/2006 | Lew | |
| 7,249,403 | B2 * | 7/2007 | Davis et al. | 27/27 |
| 7,302,743 | B2 * | 12/2007 | Fash | 27/4 |
| 7,322,079 | B2 | 1/2008 | Davis | |
| 7,805,819 | B2 * | 10/2010 | Nihipali | 27/21.1 |
| 7,882,606 | B2 * | 2/2011 | Elhaj | 27/27 |
| 8,079,119 | B1 * | 12/2011 | Ferko, III | 27/4 |
| 8,127,414 | B2 * | 3/2012 | Rankin | 27/35 |
| 8,356,392 | B2 * | 1/2013 | Jackson | 27/4 |
| 8,375,534 | B2 * | 2/2013 | Gesell et al. | 27/4 |
| 8,607,423 | B2 * | 12/2013 | Davis et al. | 27/35 |
| 2010/0218351 | A1 * | 9/2010 | Rankin | 27/17 |
| 2013/0160258 | A1 | 6/2013 | Davis | |

OTHER PUBLICATIONS

Crematory Manufacturing and Service, Inc., Operation Manual CMS Millennium II Cremator, last revised Mar. 27, 2002 [retrieved Oct. 5, 2013], Retrieved from the Internet <URL: http://www.crematorymanufacturing.com/CM_Files/m2oper.pdf>.

* cited by examiner

*Primary Examiner* — William Miller
(74) *Attorney, Agent, or Firm* — Dennis JM Donahue, III; CreatiVenture Law, LLC

(57) ABSTRACT

A device and system for assisting in the loading of a cremation container with a bottom surface into a crematory chamber with a floor. The device and system include a cylindrical body, with the body having a longitudinal axis and an external surface extending a length between a first end and a second end. The device and system further include an adhesive applied to the external surface, at one or more points along the length of the cylindrical body. The adhesive temporarily attaches the cylindrical body to the bottom surface of the cremation container.

20 Claims, 6 Drawing Sheets

CREMATION BOX AND ROLLER SYSTEM

CROSS-REFERENCE TO RELATED APPLICATIONS

Not Applicable.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to an improved cremation box and roller system, and more particularly to a cylindrical body, e.g., a roller, and an adhesive applied to the cylindrical body for temporarily attaching the roller to the cremation box for loading into a crematory chamber.

2. Related Art

Prior art crematory devices have been used to load or otherwise move a cremation box, casket or other container into a chamber for cremation. Many prior art devices either a stationary roller positioned outside the crematory chamber such as in U.S. Pat. No. 4,890,367 which is incorporated by reference, a roller that is positioned in the cremation chamber prior to loading the cremation container described in the crematory operation manual of Crematory Manufacturing and Service (CMS) or none at all such as may be suggested by the support skids in U.S. Pat. No. 7,322,079 which is also incorporated by reference herein along with the other patent references cited in the accompanying information disclosure statement.

Prior to the present invention, there has been a safety issue with the use of the roller for loading the box in the crematory chamber according to known procedures, such as described in the CMS manual. According to the known procedures, the operator must reach into the preheated crematory chamber, which is approximately 1000° F., and places the roller on the brick floor of the crematory chamber. In placing the roller on the floor, it is possible for the operator to accidentally touch the floor or the side wall of the chamber causing bodily harm to the operator. Also, when the roller is placed in entrance of the chamber, the roller can actually roll further into the chamber which may cause the operator to reach into the preheated chamber to retrieve the roller and start over. This possibility increases as the floor of the crematory is worn by use.

With present roller systems, the dependability of the roller placement is also an issue. If the roller is not placed perpendicular to the travel of the box into the crematory chamber, it can shift causing it to go out of line and not work as a "rolling fulcrum" during the loading process. This is very common because of the nature of the loading process in which there is intense heat radiating from the chamber. Accordingly, the loading process happens in a matter of seconds to avoid being exposed to this intense heat and to avoid having too much heat escape from the chamber.

While prior art devices with a loader which has a frame and a slidable support surface greatly reduce the effort of the operator in loading the box into the chamber and do not have the safety and shifting issues of the roller and box systems, the costs of such loader systems are prohibitively expensive for many crematories. Accordingly, there is a need for a less expensive yet more reliable system to load cremation boxes into the crematory chamber. It would also be beneficial to provide a system which does not require much if any retrofits to the crematory chamber as this would also increase costs.

SUMMARY OF THE INVENTION

An exemplary embodiment of the present invention includes a device for assisting in the loading of a cremation container with a bottom surface into a crematory chamber with a floor. The device is a roller with an adhesive or other releasable attachment between the roller and the cremation container that temporarily attaches the roller to the bottom surface of the container.

In some embodiments, the cylindrical body has a first position where the cylindrical body is attached to the bottom surface of the cremation container by the adhesive, and a second position where the cylindrical body is in rolling contact with the bottom surface and is not attached to the bottom surface of the cremation container.

Furthermore, in some embodiments, the device comprises a protective layer of film removably attached to the adhesive, where the protective layer of film is removed from the adhesive prior to attaching the cylindrical body to the bottom surface of the cremation container. For example, the adhesive may be a double-faced tape.

In some embodiments, the cylindrical body elevates at least a portion of the bottom surface of the cremation container above the floor of the crematory chamber, thereby reducing sliding friction between the bottom surface of the container and the floor.

Another exemplary embodiment of the present invention includes a system for loading a crematory chamber, where the chamber has a floor. The system comprises a cremation container, with the container having a bottom surface, and a cylindrical body having a longitudinal axis and an external surface extending a length between a first end and a second end. The system further comprises an adhesive having a first side, a second side and a film layer removably attached to the second side in a first arrangement and detached from the second side in a second arrangement, where the first side is applied to at least one of the bottom surface of the cremation container and/or the external surface of the cylindrical body. The second side of the double-sided adhesive attaches the cylindrical body to the cremation container when the film layer is in said second arrangement.

Another exemplary embodiment of the present invention includes an improved cremation container system having a box with a bottom surface and a roller with a longitudinal axis that is beneath the box. The improved system has any means for releasably attaching the roller to the bottom surface of the box, thereby temporarily attaching the roller to the box.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
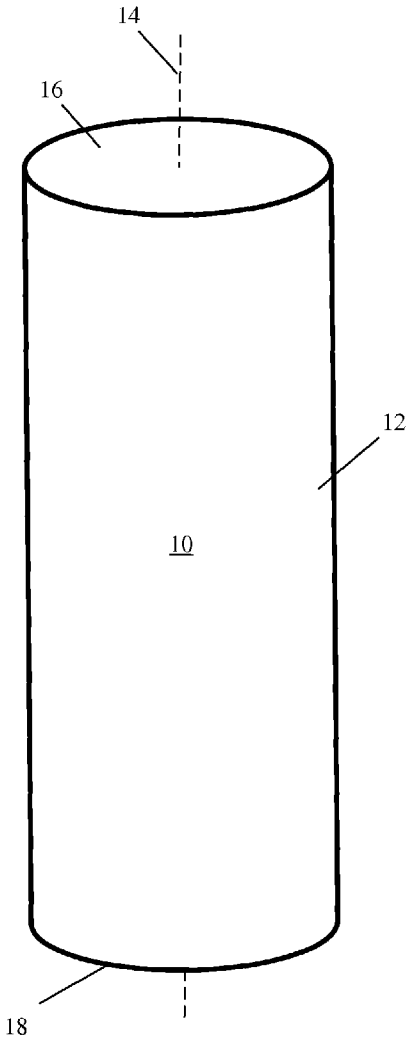
FIGS. 1A and 1B are exemplary embodiments of a cylindrical body according to aspects of the present invention.
Figure 1B:
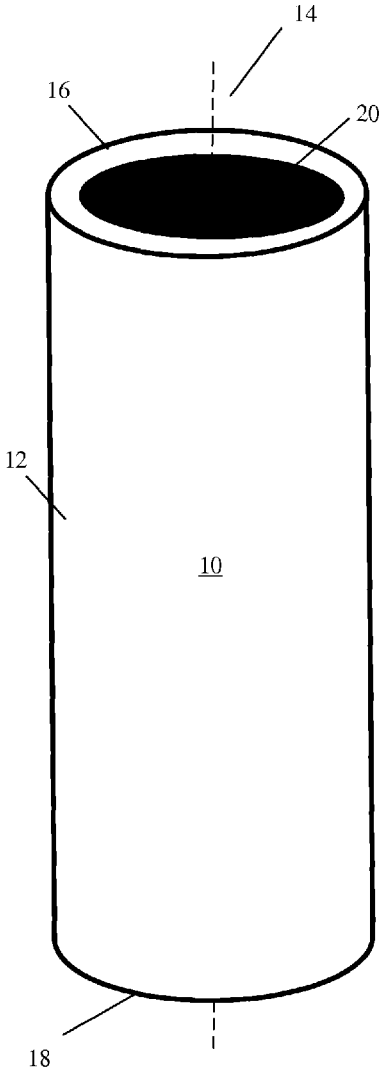

In one embodiment, the present invention is a device for assisting in the loading of a cremation container into a crematory chamber. As illustrated in FIGS. 1A and 1B, the exemplary device comprises a cylindrical body 10 having a longitudinal axis 14, a first end 16 and a second end 18, and an external face 12 extending a length between the first end 16 and the second end 18. The cylindrical body 10 is preferably a tube with an open interior 20 as shown in FIG. 1B although it may also be solid cylinder as shown in FIG. 1A. One of ordinary skill in the art will recognize that it is within the scope of the present invention that various materials and configurations may be used for a cylindrical body, although the preferred materials are combustible and consumed to ash during the cremation process in the crematory.

Figure 2A:
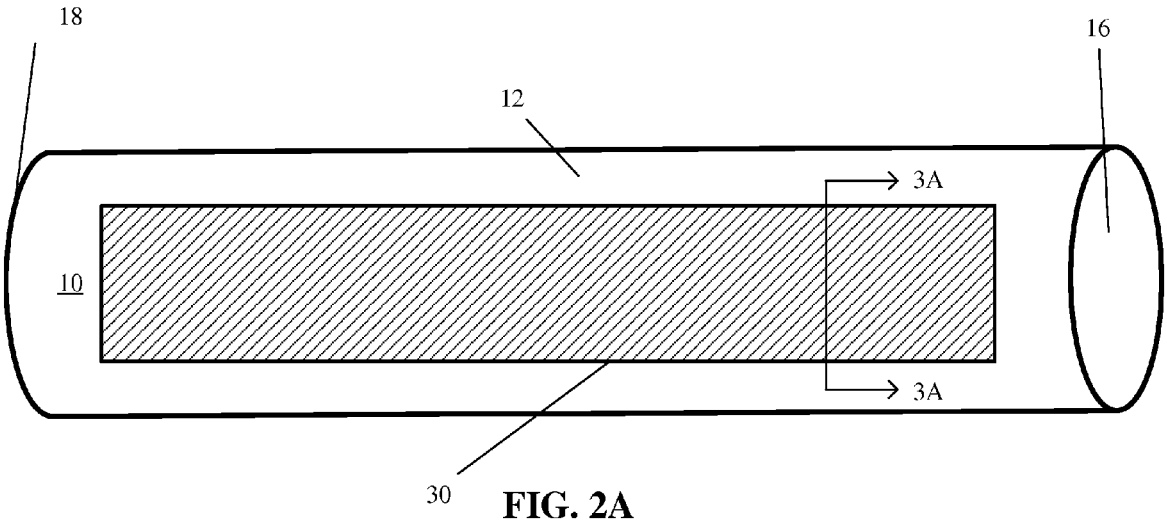
FIG. 2A is an exemplary embodiment of a cylindrical body with an attached adhesive according to aspects of the present invention.
Figure 2B:
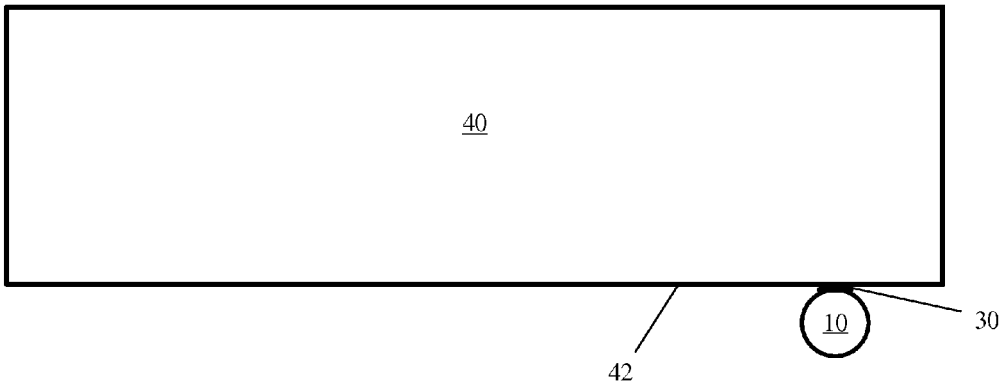
FIG. 2B is an exemplary embodiment of the cylindrical body attached to a cremation container by the adhesive according to aspects of the present invention.
Figure 2C:
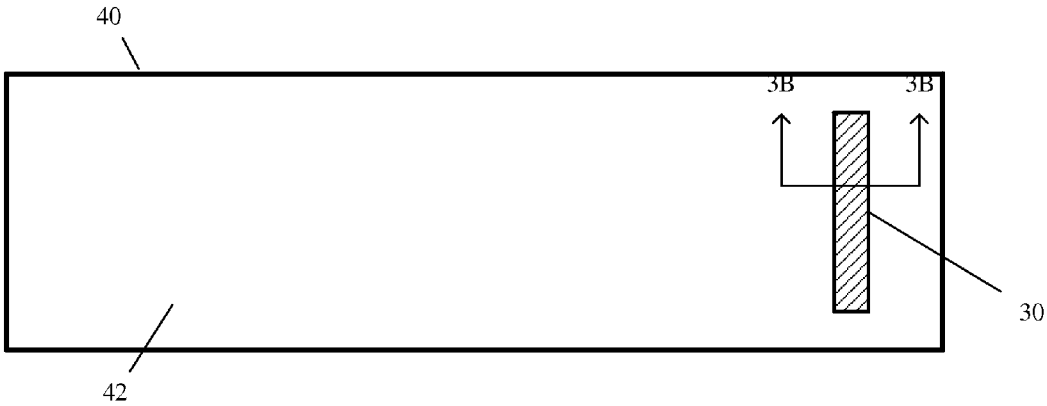
FIG. 2C is an exemplary embodiment of the cremation container with an attached adhesive according to aspects of the present invention.

According to aspects of the present invention, the exemplary device illustrated in FIG. 2A further comprises an adhesive 30 applied to the external surface 12 of the cylindrical body 10. For example, the adhesive may be a double-sided tape, glue or epoxy, or any other suitable material. The adhesive may be applied, affixed, or otherwise attached to the exterior 12 of the cylindrical body 10 in a continuous section, at a plurality of locations along the length of the exterior 12. The adhesive 30 permits, among other things, the cylindrical body 10 to be attached to a bottom surface 42 of a cremation container 40, as illustrated in FIG. 2B. Alternatively, as shown in FIG. 2C, the adhesive may be applied to the bottom of the cremation container 40.

Figure 3A:
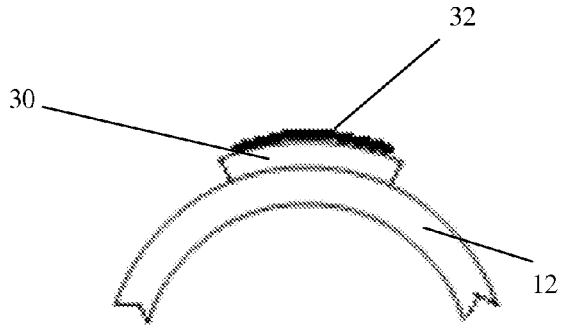
FIGS. 3A and 3B are cross-sectional views of the cylindrical body and cremation container in FIGS. 2A and 2C, respectively.
Figure 3B:
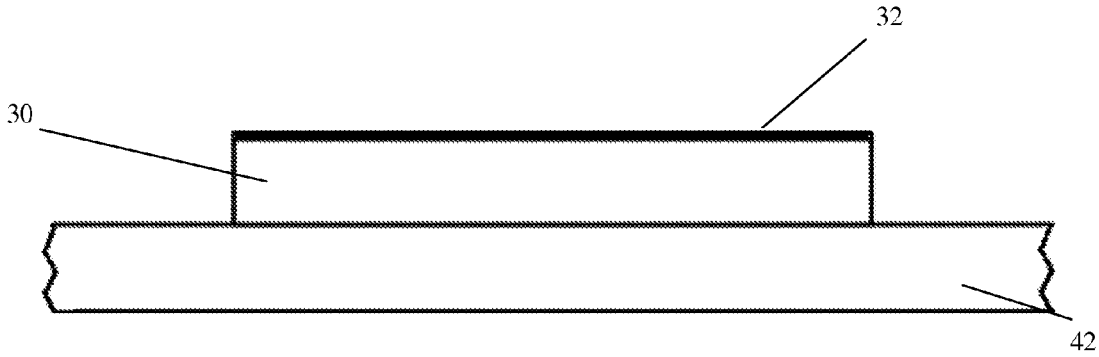

In the preferred embodiment, the device includes a protective layer of film 32 over the adhesive 30 so that the cremation container and roller are not attached until they are ready to be placed in the cremation chamber. In these embodiments, the protective layer of film 32 is removed from the adhesive 30 prior to attaching the body 10 to the bottom surface 42. Cross-sectional views of the film over the adhesive that is attached to the roller and the cremation box are shown in FIGS. 3A and 3B, respectively. Once attached, the cylindrical body 10 remains temporarily in place on the cremation container as illustrated in FIG. 2B, prior to the cremation container 40 being inserted into a crematory chamber.

Figure 4A:
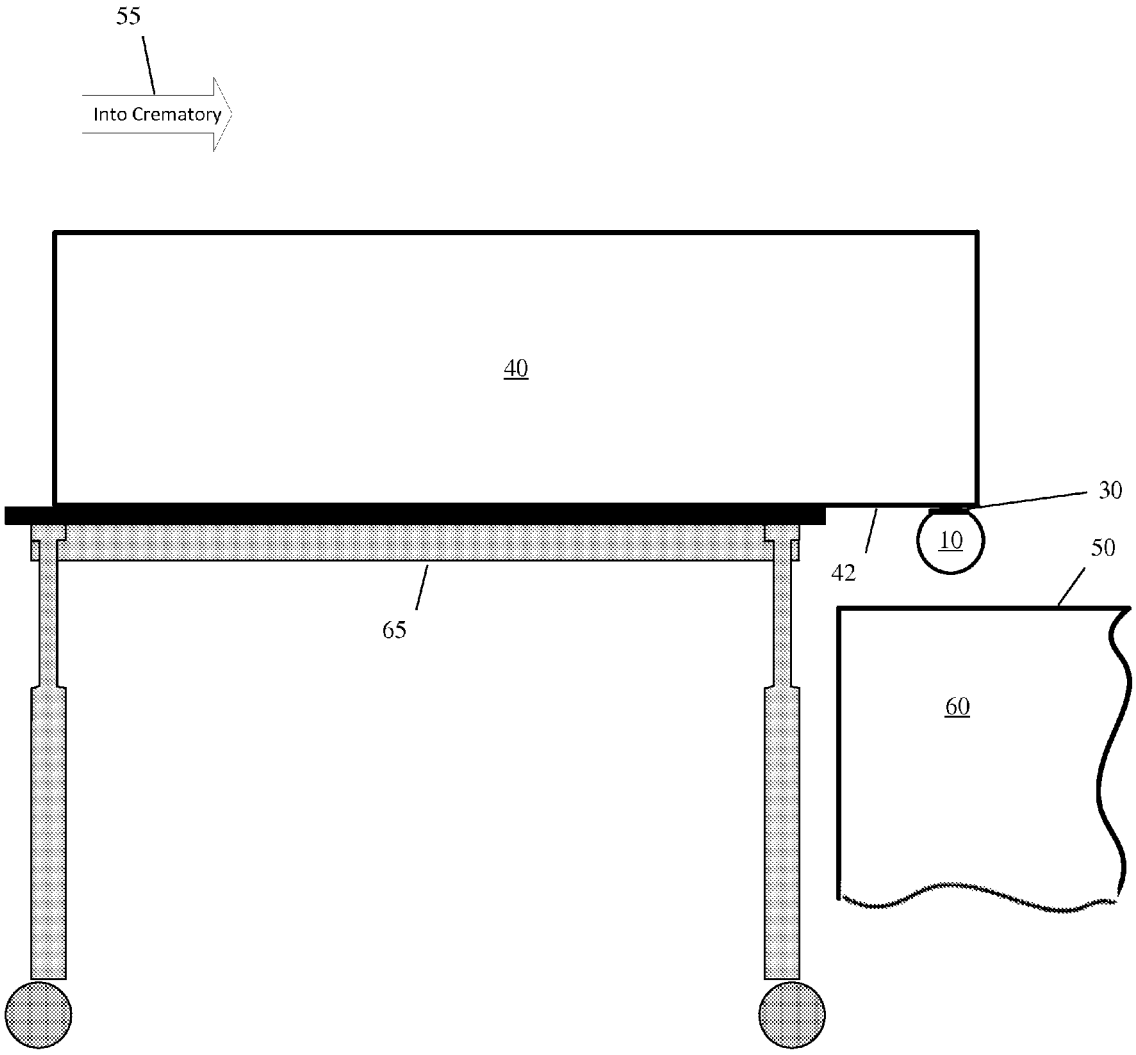
FIGS. 4A-C are exemplary illustrations of the process for inserting a cremation container with an attached cylindrical body into a crematory chamber.
Figure 4B:
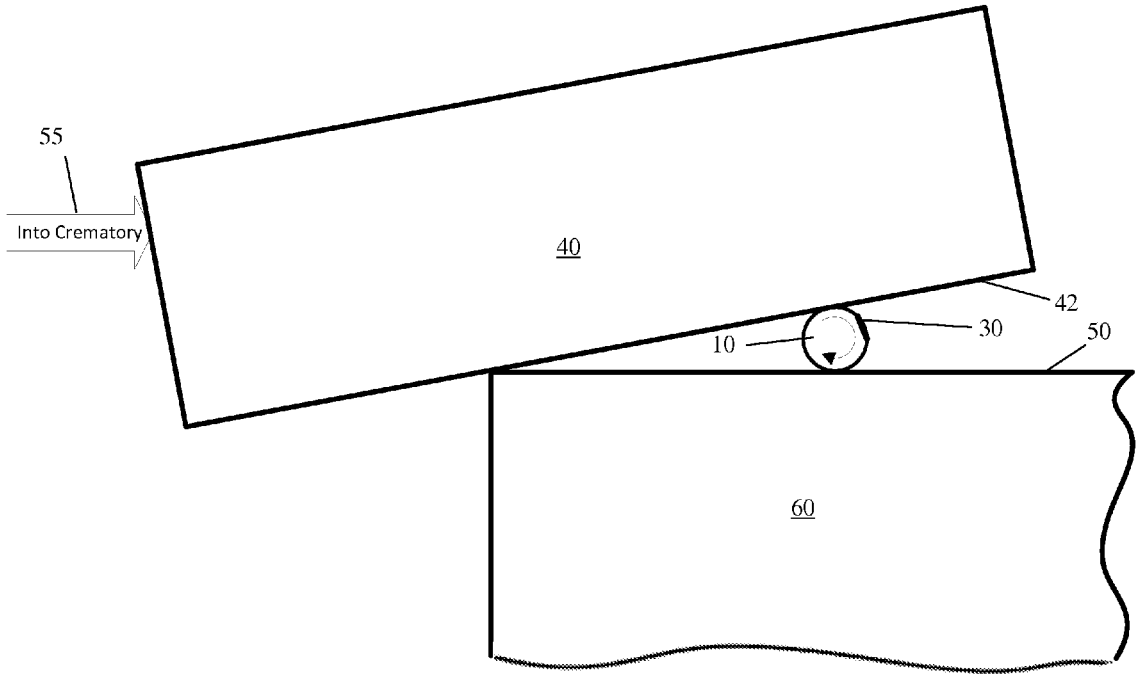
Figure 4C:
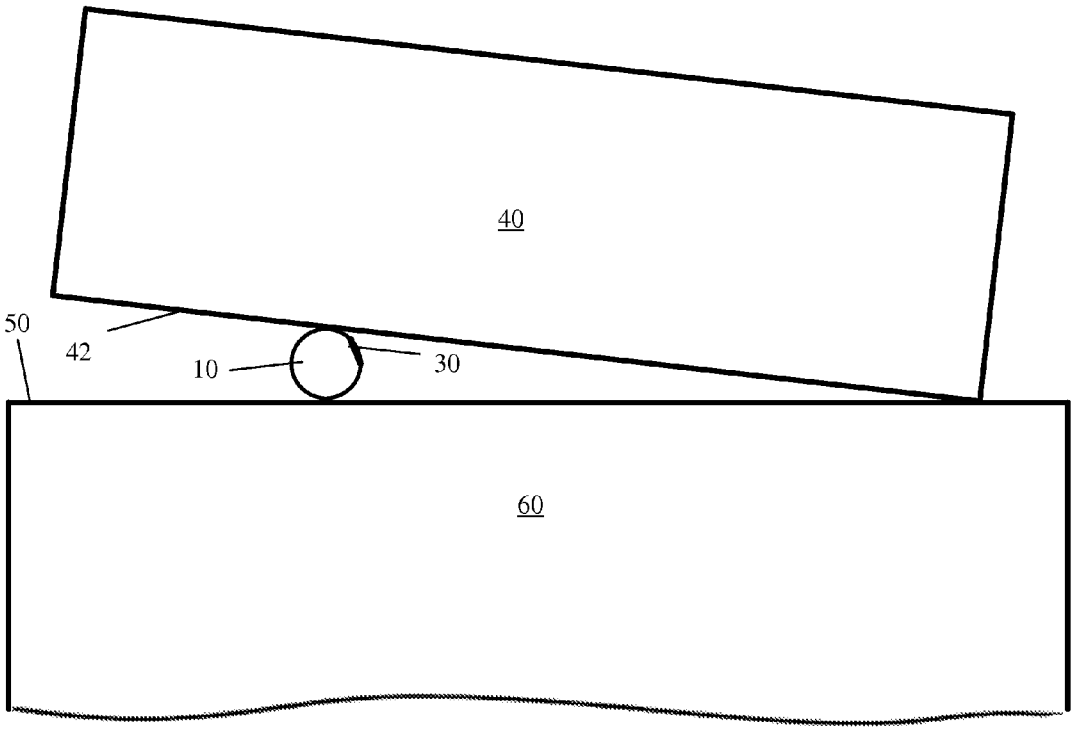

An exemplary loading process is shown in FIGS. 4A-4C, illustrating the insertion of a cremation container, e.g., box, into a crematory chamber according to the present invention. While FIGS. 4A-4C do not illustrate a crematory chamber in its entirety, one of ordinary skill in the art will understand that a cremation chamber has a number of elements, such as those illustrated in the prior art references noted above. In FIGS. 4A-4C, a portion of the cremation chamber is illustrated at element 60, where the cremation chamber has a floor 50 upon which a cremation container 40 is inserted for cremation.

An exemplary setup for beginning the loading process is shown in FIG. 4A, where the cremation container 40 with the attached cylindrical body 10 is placed into an opening of the cremation chamber 60. The cylindrical body 10 can be attached to the container 40 while the container is positioned away from the entrance to the cremation chamber. For example, a forward section of the container can overhang a lift table 65 that is on wheels and can be wheeled to the entrance of the cremation chamber 60. The container 40 is then pushed into cremation chamber 60 and the table is lowered so that the attached cylindrical body 10 comes in contact with the floor 50 of the cremation chamber.

In FIG. 4B, the container 40 is inserted further into the cremation chamber 60. During insertion of the container 40 into the cremation chamber 60, the cylindrical body 10 detaches from its initial attachment point and begins to rotate beneath the container 40. Generally, the frictional force between the floor 50 and the cylindrical body 10 as the container 40 is being forced into the cremation chamber 60 causes the adhesive between the container and the cylindrical body to release so that the cylindrical body is able to roll under the weight of the container. In the preferred embodiment of the present invention, the longitudinal axis 14 of the cylindrical body 10 remains substantially perpendicular to the direction of travel 55. In other words, the cylindrical body 10 remains beneath the container 40 during the loading process as a "rolling fulcrum" rather than being pushed away by the container 40 during the initial insertion or shifting and going out of line such as in the standard operations when there is no adhesive or other attaching means. When the box is on top of the roller and the roller is properly aligned, even after the adhesive releases the force of the box pushing down on the roller keeps it in position so that it doesn't roll away or shift and go out of line.

It will be appreciated that other methods of temporarily attaching the cylindrical body 10 to the container 40 and then forcing the release of the attachment are also within the scope of the present invention. For example, hook and loop fasteners (such as VELCRO® fasteners) attached to the roller and the box may be used. This may not be the preferred operation for the inventive system because each time the portion of the roller with the fastener material touches the box and the floor of the crematory chamber, it may skid a little and may require more force to push the box to overcome this skidding action. This would occur during each rotation until the fastener material burns off of the roller. In comparison, the adhesive material is much thinner and burns off almost immediately, on the first or second rotation due to the extreme temperatures so there is very little resistance after the initial release of the adhesive.

The insertion process continues as shown in FIG. 4C, where the released cylindrical body 10 is in rolling contact with both the bottom 42 of the container 40 and the floor 50. During the insertion process, the cylindrical body 10 rolls beneath the container 40, acting as a moving "fulcrum" that elevates a portion of the bottom 42 of the container 40 above the floor 50, thereby reducing the amount of sliding friction between the bottom 42 of the container 40 and the floor 50.

According to aspects of the present invention, the cylindrical body 10 is preferably formed from a combustible material, such as cardboard, bamboo, wood or some other natural product, which can be consumed during the cremation process along with the cremation container. As indicated in the CMS operation manual, metal rollers may damage the floor of the crematory chamber and are typically avoided. However, the present invention would work with any type of roller material, including a combustible material as described above or non-combustible materials, such as metal and ceramic materials.

According to aspects of the present invention, a system of loading a crematory chamber may comprise one or more of the elements described above, such as a cremation container 40, a cylindrical body 10, and an adhesive 30. Furthermore, an improved cremation container system may comprise one or more of the elements describe above, such as an improvement comprising an adhesive 30. One of ordinary skill in the art will recognize that other devices, systems, improvements, and method that incorporate the elements described above are within the scope of the present invention.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, there are a number of combustible devices that may be able to attach the roller to the cremation box prior to the box being placed in the cremation chamber, and such attachments are within the scope of the present invention. Generally, any releasable attachment between the roller and the box would improve the safety of the roller-box system and would avoid the shifting of the "rolling fulcrum" that are issues with the current systems. Thus, the breadth and scope of the present invention should not be limited by any of the above-described exemplary embodiments, but should be defined only in accordance with the following claims appended hereto and their equivalents.

What is claimed is:

1. A device for assisting in the loading of a cremation container with a bottom surface into a crematory chamber, the chamber having a floor, said device comprising:

a cylindrical body, said body having a longitudinal axis and an external surface extending a length between a first end and a second end; and an adhesive applied to said external surface along said length, wherein said adhesive temporarily attaches said cylindrical body to the bottom surface of the cremation container, and wherein said cylindrical body has a first position wherein said cylindrical body is attached to the bottom surface of the cremation container by said adhesive, wherein said cylindrical body has a second position wherein said cylindrical body is in rolling contact with the bottom surface and is not attached to the bottom surface of the cremation container.

2. The device of claim 1, wherein said cylindrical body remains in said first position as the cremation container is initially placed on the floor of the crematory chamber and wherein said adhesive between said cylindrical body and the cremation container releases as the box is pushed further into the crematory chamber.

3. The device of claim 1, wherein said device comprises a protective layer of film removably attached to said adhesive, wherein said protective layer of film is removed from said adhesive prior to attaching said cylindrical body to the bottom surface of the cremation container.

4. The device of claim 1, wherein said adhesive is applied at a plurality of locations along the length of said external surface.

5. The device of claim 1, wherein said adhesive comprises a double-faced tape.

6. The device of claim 1, wherein the cremation container is inserted into the crematory chamber along a direction of travel and said longitudinal axis of said cylindrical body is substantially perpendicular to said direction of travel, and wherein said cylindrical body forms a rolling fulcrum for the cremation container relative to the floor of the crematory chamber, elevating at least a portion of the bottom surface of the cremation container above the floor of the crematory chamber, thereby reducing sliding friction between the bottom surface and the floor.

7. A system for loading a crematory chamber, the chamber having a floor, said system comprising:

a cremation container, said container having a bottom surface;

a cylindrical body, said body having a longitudinal axis and an external surface extending a length between a first end and a second end; and a double-sided adhesive having a first side, a second side and a film layer removably attached to said second side in a first arrangement and detached from said second side in a second arrangement, wherein said first side is applied to at least one of said bottom surface of said cremation container and said external surface of said cylindrical body, wherein said second side of said double-sided adhesive attaches said cylindrical body to said cremation container when said film layer is in said second arrangement, wherein said cylindrical body has a first position wherein said cylindrical body is attached to said bottom surface of said cremation container by said double-sided adhesive, wherein said cylindrical body has a second position wherein said cylindrical body is in rolling contact with the floor and said bottom surface and is not attached by said double-sided adhesive to said bottom surface of the cremation container.

8. The system of claim 7, wherein said first side of said adhesive is applied along at least a portion of said length of said external surface.

9. The system of claim 7, wherein said cremation container is inserted into the cremation chamber along a direction of travel and said longitudinal axis of said cylindrical body is substantially perpendicular to said direction of travel, wherein said first side of said adhesive is applied to said bottom surface of said cremation container in an orientation corresponding with said longitudinal axis of said cylindrical body and substantially perpendicular to said direction of travel.

10. The system of claim 7, wherein said adhesive comprises a double-faced tape.

11. The system of claim 7, wherein said cylindrical body remains in said first position as said cremation container is inserted into the crematory chamber.

12. An improved cremation container system having a box with a bottom surface and a roller with a longitudinal axis beneath the box, the improvement comprising a means for releasably attaching the roller to the bottom surface, wherein said releasable attachment means temporarily attaches the roller to the bottom surface of the box, wherein the roller has a first position attached to the bottom surface of the box by said releasable attachment means and a second position in rolling contact with the bottom surface with said releasable attachment means having released the roller from attachment to the bottom surface of the box, and wherein said releasable attachment means remains applied to at least one of said roller and said bottom surface when said roller is in said second position.

13. The improved cremation container system of claim 12, wherein said releasable attachment means further comprises an adhesive applied to at least one of the roller and the box and a film layer removably attached to said adhesive, wherein said film layer is removed from said adhesive prior to attaching the roller to the bottom surface of the box, and wherein the box is inserted into a cremation chamber along a direction of travel and a longitudinal axis of the roller is substantially perpendicular to said direction of travel.

14. The improved cremation container system of claim 13, wherein said adhesive comprises a double-faced tape with a first face and a second face, wherein said first face is applied to at least one of the roller and the bottom surface of the box, wherein one application of said adhesive to said roller is along an external surface of the roller parallel with the longitudinal axis and another application of said adhesive to the bottom surface of the box is in an orientation corresponding with the longitudinal axis of the roller and substantially perpendicular to said direction of travel, wherein said film layer is removably attached to said second face in a first arrangement and detached from said second face in a second arrangement, and wherein said second face of said double-faced tape attaches the cylindrical body to the bottom surface of the box when said film layer is in said second arrangement.

15. A device for assisting in the loading of a cremation container with a bottom surface into a crematory chamber, the chamber having a floor, said device comprising:

a cylindrical body, said body having a longitudinal axis and an external surface extending a length between a first end and a second end; and an adhesive applied to said external surface along said length, wherein said adhesive temporarily attaches said cylindrical body to the bottom surface of the cremation container, wherein said adhesive comprises a double-faced tape.

16. The device of claim 15, wherein said cylindrical body has a first position wherein said cylindrical body is attached to the bottom surface of the cremation container by said adhesive, wherein said cylindrical body has a second position wherein said cylindrical body is in rolling contact with the bottom surface and is not attached to the bottom surface of the cremation container.

17. A system for loading a crematory chamber, the chamber having a floor, said system comprising:

a cremation container, said container having a bottom surface;

a cylindrical body, said body having a longitudinal axis and an external surface extending a length between a first end and a second end; and a double-sided adhesive having a first side, a second side and a film layer removably attached to said second side in a first arrangement and detached from said second side in a second arrangement, wherein said first side is applied to at least one of said bottom surface of said cremation container and said external surface of said cylindrical body, wherein said second side of said double-sided adhesive attaches said cylindrical body to said cremation container when said film layer is in said second arrangement, and wherein said adhesive comprises a double-faced tape.

18. The system of claim 17, wherein said cylindrical body has a first position wherein said cylindrical body is attached to the bottom surface of the cremation container by said adhesive, wherein said cylindrical body has a second position wherein said cylindrical body is in rolling contact with the bottom surface and is not attached to the bottom surface of the cremation container.

19. A system for loading a crematory chamber, the chamber having a floor, said system comprising:

a cremation container, said container having a bottom surface;

a cylindrical body, said body having a longitudinal axis and an external surface extending a length between a first end and a second end; and a double-sided adhesive having a first side, a second side and a film layer removably attached to said second side in a first arrangement and detached from said second side in a second arrangement, wherein said first side is applied to at least one of said bottom surface of said cremation container and said external surface of said cylindrical body, wherein said second side of said double-sided adhesive attaches said cylindrical body to said cremation container when said film layer is in said second arrangement, wherein said cremation container is inserted into the cremation chamber along a direction of travel and said longitudinal axis of said cylindrical body is substantially perpendicular to said direction of travel, and wherein said first side of said adhesive is applied to said bottom surface of said cremation container in an orientation corresponding with said longitudinal axis of said cylindrical body and substantially perpendicular to said direction of travel.

20. The system of claim 19, wherein said cylindrical body has a first position wherein said cylindrical body is attached to said bottom surface of said cremation container by said double-sided adhesive, wherein said cylindrical body has a second position wherein said cylindrical body is in rolling contact with the floor and said bottom surface and is not attached by said double-sided adhesive to said bottom surface of the cremation container.

* * * * *